United States Patent [19]

Tezuka et al.

[11] Patent Number: 4,978,580

[45] Date of Patent: Dec. 18, 1990

[54] THERMAL TRANSFER RECORDING MEDIUM

[75] Inventors: Toshiaki Tezuka; Takao Abe, both of Hino, Japan

[73] Assignee: Konishiroku Photo Industry Co., Ltd., Tokyo, Japan

[21] Appl. No.: 324,982

[22] Filed: Mar. 14, 1989

Related U.S. Application Data

[63] Continuation of Ser. No. 61,334, Jun. 11, 1987, abandoned.

[30] Foreign Application Priority Data

Jun. 24, 1986 [JP] Japan ..... 61-148635

[51] Int. Cl.[5] ..... B41M 5/26

[52] U.S. Cl. ..... 428/484; 428/195; 428/207; 428/288.4; 428/500; 428/522; 428/913; 428/914

[58] Field of Search ..... 524/272; 428/195, 207, 428/211, 484, 488.1, 488.4, 913, 914, 500, 522

[56] References Cited

U.S. PATENT DOCUMENTS

| | | | |
|---|---|---|---|
| 4,689,274 | 8/1987 | Yamahata | 428/488.1 |
| 4,698,268 | 10/1987 | Ueyama | 428/483 |
| 4,708,903 | 11/1987 | Tanraka et al. | 428/488.4 |

*Primary Examiner*—Pamela R. Schwartz

*Attorney, Agent, or Firm*—Frishauf, Holtz, Goodman & Woodward

[57] ABSTRACT

A thermal transfer recording medium comprising a support and, provided thereon in order from the support, a heat-fusible layer containing a heat-fusible substance and a thermoplastic layer containing a thermoplastic resin, a coloring agent and a cross-linking polymer.

7 Claims, 1 Drawing Sheet

THERMAL TRANSFER RECORDING MEDIUM

This application is a continuation, of application Ser. No. 07/061,334, filed June 11, 1987 now abandoned.

FIELD OF THE INVENTION

The present invention relates to a thermal transfer recording medium and, more particularly, to a thermal transfer recording medium, wherein correction of erroneously recorded portion can easily be made.

BACKGROUND OF THE INVENTION

The recent development in the field of information-processing is remarkable and in this connection, recording methods and apparatuses suitable for various systems have been developed and put to use.

Among these, thermal recording process using a heat-sensitive material is widely used in view of various advantages such as lightness, compact, noiseless and excellent and easy operation and maintenance of the the apparatus used therefor.

Among recording sheet used in the thermal recording, an ordinary heat-sensitive recording sheet has, being a color forming type containing color forming agent and developer, such disadvantages that it is expensive, that alteration of records may easily be made, that the recording sheet is liable to be color-stained by heat or with organic solvent and that the recorded images are likely to be discolored in relatively a short period of time.

Under these circumstances thermal-transfer recording system has been attracting public attention as a system for improving aforesaid disadvantages.

In the thermal-transfer recording process, a thermally-transferrable recording medium comprising, on a supporting sheet, a heat-fusible ink layer wherein coloring agents are dispersed in a heat-fusible substance is used and when the medium is heated from the side of the support by a thermal head under the condition that aforesaid ink layer is superposed on a recording sheet onto which an image is to be transferred (usually, paper), the ink layer is melted and transferred onto the recording sheet to form an ink image corresponding to the area to which heat has been applied. Owing to this process, it is possible to record on an ordinary paper and disadvantages of using aforesaid heat-sensitive recording materials have been eliminated.

However, the thermal transfer recording process having such excellent features still has a room for improvement. For example, a recorded image, which is errorneously recorded, cannot be erased easily.

Heretofore, as a method for correcting the erroneous recording in the thermal-transfer recording process, a method (hereinafter referred to as a cover-wrap meathod) wherein a cover coating whose color is identical to that of recording sheet is transferred onto the erroneously recorded portion thereby the erroneously recorded portion is covered and another method (hereinafter referred to as a lift-off method) wherein the erroneously recorded portion is peeled off by an adhesive tape, have been known.

Among aforesaid two methods, the lift-off method that does not deteriorate the reproducibility is considered advantageous when the reprinted image is to be further copied through a transmission mode.

When a wax is used as the pricipal ingredient of a binder for the ink layer, the ink tends to blots on a recording sheet upon printing and it sometimes makes difficult to correct misprints by the lift-off method. On the other hand, when the principal ingredient of the binder in the ink layer is polymer, it is possible, to a certain extent, to correct such misprints by the lift-off method because ink does not easily blots on the recording paper.

It has been difficult to attain both good transferability and fixing characteristics in printing and easy exfoliation from paper in correction at the same time.

In this connection, as disclosed in Japanese Patent Publication Open to Public Inspection No. 230893 (hereinafter referred to as Japanese Patent O.P.I. Publication), an attempt to provide on the ink layer a release layer which accelerates the exfoliation from paper has been made for the purpose of improving correction properties. By this method, although correcting properties be improved, however, the transferability and the fixing property of recorded ink image may be deteriorated and aforesaid problems are not satisfactorily solved.

SUMMARY OF THE INVENTION

The present invention has been accomplished in view of aforesaid actual circumstances and its object is to provide a thermal-transfer recording medium whereby improved transferability and fixing characteristics in the recording and better exfoliation ability from the recording sheet upon correction can be obtained.

The object of the present invention can be attained by a thermal transfer recording medium comprising a support and, provided thereon in order from the support, a heat-fusible layer containing a heat-fusible substance and a thermoplastic layer containing a thermoplastic resin and a cross-linking polymer.

Figure 1:
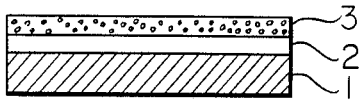
FIGS. 1, 2, 3 and 4 represent transverse sectional views which are viewed in the direction parallel to the surface of the thermal transfer recording medium of the invention and are intended to illustrate the arrangement of the recording medium.

In the drawing the numerals denote as follows:

1 . . . . . Support
2 . . . . . Heat-fusible layer
3 . . . . . Thermoplastic layer
4 . . . . . Sticking-prevention layer

DETAILED DESCRIPTION OF THE INVENTION

In accordance with one of the preferable embodiments of the present invention the thermal-transfer recording medium of the present invention comprises, on the support, at least two laminated layers each of which is different from others in its constitution, wherein the layer which is closest to the support is a heat-fusible layer containing heat-fusible substances as a principal ingredient and the layer laminated on aforesaid heat-fusible layer is a thermoplastic layer containing thermoplastic substances and coloring agents as a principal ingredient and further containing a cross-linking polymer preferably at a proportion of 5% to 40% by weight with respect to 100 parts by weight of the total amount of solids in the thermoplastic layer.

According to the study by the inventors, it is effective for the viscosity of ink heated by a thermal head to be low for the better transferability to the recording sheet and fixability of recorded images in printing, while for the better exfoliation of the recorded image from the recording sheet for correction, it is effective for the ink to have a higher elasticity when heated for printing.

However, by the use of a conventional ink, it has been impossible to satisfy aforesaid conditions. Namely, ink having low viscosity when heated, thus satisfying transferability and fixing characteristics, hardly has higher elasticity which makes the correction by exfoilation easier. Contrary to this ink having, when heated, higher elasticity which makes the correction by exfoilation easier does not have low viscosity and, thus, does not satisfy transferability and fixing characteristics.

The inventors of the invention have found that the the viscosity increase in such ink composition can be restrained to a relatively low level when ink contains a cross-linking polymer, preferably at a proportion of 5% to 40% by weight, in comparison with one containing no cross-linking polymer. The inventors have also found that with the ink of the present invention, elasticity of the ink can be raised to a higher level. Further, it has been found possible that the transferability of the heat-transfer medium can be improved by making a heat-fusible layer present between a support and an ink layer. The schematic layer arrangements of the thermal-transfer recording medium of the invention are shown in FIGS. 1–4. In FIGS. 1–4, 1 denotes a support, 2 denotes a heat-fusible layer, 3 denotes a thermoplastic layer and 4 denotes a sticking-prevention layer.

Figure 2:
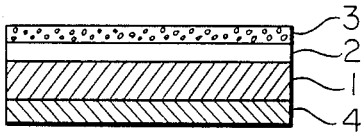
Figure 3:
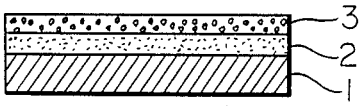
Figure 4:
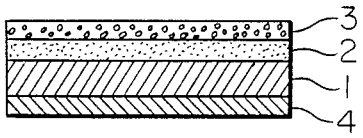

Coloring agent is usually contained, as shown in FIGS. 1 and 2, in the thermoplastic layer and it may also be added to the heat-fusible layer in addition to the thermoplastic layer as shown in FIGS. 3 and 4.

As a heat-fusible substance used in the invention, there can be mentioned a substance which is solid or semi-solid at the room temperature and the one whose melting point (measured values obtained by Yanagimoto MPJ-2 Model) or softening point (measured values obtained by a ring and ball method) is in the range of from 25° C. to 120° C. is preferable.

According to the more preferable embodiment of the present invention, a solid substance in the range from 40° C. to 120° C. can be mentioned.

To be specific, waxes including vegetable wax such as carnauba wax, haze wax, auricuri wax, esparto wax etc.; animal wax such as bees wax, insect wax, shellac wax, spermaceti and others; petroleum wax such as paraffin wax, microcrystalline wax, ester wax and wax oxide etc.; mineral wax such as montan wax, ozokerite and ceresine etc.; higher fatty acid such as palmitic acid, stearic acid, margaric acid and behenic acid etc.; higher alcohol such as palmityl alcohol, stearyl alcohol, behenyl alcohol, marganyl alcohol, myricyl alcohol and eicosanol etc.; higher fatty acid ester such as cetyl palmitate, myricyl palmitate, cetyl stearate, myricyl stearate and others; amidos such as acetamidi, propionic acid amide, palmitic acid amide, stearic acid amide and amido wax etc.; rosin derivatives such as ester gum, rosin maleic acid resin, rosin phenol resin, hydrogenated rosin; high molecular substances such as phenol type resin, terpene type resin, xylene type resin, low molecular weight styrene resin, petroleum type resin, aromatic hydrocarbon type resin, ethylene-vinyl acetate copolymer, ethylene-ethyl acrylate copolymer, styrene-butadiene copolymer, ionomer type resin, polyamide type resin, polyester type resin, epoxy type resin, polyurethane type resin, acryl type resin, vinyl chrolide type resin, cellulose type resin, polyvinyl alcohol type resin, styrene resin, isoprene rubber, chloroprene rubber, natural rubber and others and higher amines such as stearylamine, behenylamine, palmitylamine and others are given and further, 'heat-fusible solid ingredients that are solid at room temperature' disclosed in Japanese Patent O.P.I Publication No. 68253/1979 and 'vehicle' described in Japanese Patent O.P.I. Publication No. 105579/1980 may also be used.

Aforesaid heat-fusible substances are easily caused to become aqueous dispersed products and thereby used conveniently.

These heat-fusible substances may be used independently or in combination of two or more kinds of them.

There is no restriction for the composition ratio of ingredients forming a heat-fusible layer in the invention, but it is preferable that 10 parts or more by weight (more preferably, 30 parts or more by weight) of heat-fusible substances are used for 100 parts by weight of total amount of solids in the heat-fusible layer.

Further, coloring materials may optionally be added to the heat-fusible layer. As for the coloring materials, the color forming agents described later in this specification may be used. It is preferable that 20 parts and less by weight of coloring materials are used for 100 parts by weight of total amount of solids in the heat-fusible layer.

In addition to aforesaid ingredients, various kinds of additives may be added to the heat-fusible layer of the invention. For example, vegetable oil such as castor oil, linseed oil and olive oil, animal oil such as whale oil and mineral oil may be used conveniently. Furthermore, anion surfactant, cation surfactant, nonion surfactant and amphoteric surfactant may be used conveniently.

The thickness of the heat-fusible layer of the invention is in the range from 0.5 μm to 3.5 μm and it is preferably in the range from 1.5 μm to 3.0 μm and more preferably in the range from 1.7 μm to 2.7 μm.

As thermoplastic substances (hereinafter referred to as a thermoplastic polymer) used in the invention, rosin derivatives such as ester gum, rosin maleic acid resin, rosin phenol resin and hydrogenated rosin, phenol type resin, terpen type resin, xylene type resin, petroleum type resin, aromatic hydrocarbon type resin, ionomer resin, polyester type resin, polyamide type resin, polyethylene-polypropylene type resin are given and these are easily caused to become aqueous dispersed products through the known methods.

As a polymer which is more preferable, acryl type resin may be given. The acryl type resin may be prepared through the emulsion polymerization of monobasic carboxylic acid such as acrylic acid or methacrylic acid or its ester and at least one kind of a monomer capable of copolymerizing. As a carboxylic acid monomer, ester of acrylic acid or methacrylic acid such as methyl ester, ethyl ester, isopropyl ester, butyl ester, isobutyl ester, amyl ester, hexyl ester, octyl ester, 2-ethylhexyl ester, decyl ester, dodecyl ester, hydroxyethyl ester and hydroxypropyl ester are given. As a monomer capable of copolymerizing, there may be given vinyl acetate, vinyl chloride, vinylidene chloride, maleic anhydride, fumaric anhydride, styrene, 2-methylstyrene, chlorostyrene, acrylonitrile, vinyltoluene, N-methylolacryamide, N-methylolmethacrylamide. N-butoxymethylacrylamide, N-butoxymethacrylamide, vinyl pyridine, N-vinylpyrolidone and others, and the monomer capable of copolymerizing is selected from one kind or 2 kinds or more of the foregoing.

Further, diene type copolymers are also preferable and an emulsion-polymerized product of a diene type monomer such as butadiene, isoprene, isobutylene and chloroprene and aforesaid monomer capable of copolymerizing, for example, butadiene styrene, butadiene-styrene-vinylpyridine, butadiene-acrylonitrile, chloroprene-styrene, chloropreneacrylonitrile and others may be usable.

As a polymer which is more preferable, there may be given an ethylene copolymer the example of which includes coplymers such as ethylene-vinyl acetate, ethylene-ethyl acrylate, ethylene-methyl methacrylate, ethylene-isobutyl acrylate, ethylene-acrylic acid, ethylene-vinyl alcohol, ethylene-vinyl chloride and ethylene-metallic salt acrylate.

In addition to the foregoing, polyurethane type polymer and polyester type polymer are given as a thermoplastic polymer.

As to the cross-linking polymers used in the present invention, any one which is generally called as a cross-linking polymer can be used. Namely, aforesaid cross-linking polymer is a polymer which is produced through copolymerization of a plurality of different kinds of monomers, at least one of which is a monomer having two (bi-functional) or more (multi-functional) functional groups, which causes crosslinking upon polymerlization reaction. As preferable examples of the functional group, a vinyl group, a carboxylic group, a hydroxyl group, an amino group, an isocyanate group and a peroxy group may be mentioned.

As representative examples of the cross-linking polymer of the present invention, a copolymer of styrene and divinylbenzene, a copolymer of ethylene and 2,5-dimethyl-2,5-di(t-butylperoxy)hexane, a copolymer of ethylene, vinyl acetate and dicumylperoxide, a copolymer of vinyl chloride, dicumylperoxide and divinylbenzene, a coplymer of polypropyrene, benzoylperoxide and divinyl benzene, a copolymer obtained a copolymerization of a composition of vinyl acetate and a small amount of vinyl adipate added thereto, a polycondensation product of glycerol and phthalic acid and cross-linking polymer emulsion which is produced through the cross-linking polymerization conducted during emulsion polymerization may be mentioned.

Among these cross-linking polymer, a copolymer of styrene and divinylbenzene is most preferable.

As coloring agents to be used in the invention, carbon black is preferable and any of other inorganic pigment, organic pigment or organic dye may be used. Examples of organic pigment include titanium dioxide, zinc oxide, Prussian blue, cadmium sulfide, iron oxide and zinc, barium chromate and calcium chromate. As an organic pigment, azo, thioindigo, anthra quinone, anthraanthrone, triphendioxazine type pigment, vat dye, phthalocyanine pigment, for example, copper phthalocyanine and its derivatives and quinacridone are given.

As an organic dye, acid dye, direct dye, dispersed dye, oil-soluble dye and metal-containing oil-soluble dye are given.

In the present invention, the composition ratio of ingredients forming a thermoplastic layer is 5–40 parts by weight (more preferably, 5–35 parts by weight) of coloring agents, 5–90 parts by weight (more preferably, 10–90 parts by weight) of thermoplastic substances and 5–40 parts by weight of cross-linking polymers in the thermoplastic substances with respect to 100 parts by weight of the total amount of solids in the thermoplastic layer.

Various kinds of additives may be contained in the thermoplastic layer of the invention, in addition to aforesaid ingredients. For example, vegetable oil such as castor oil, linseed oil and olive oil, animal oil such as whale oil and mineral oil may be used conveniently. Furthermore, anion surfactant, cation surfactant, non-ion surfactant and amphoteric surfactant may be used conveniently.

The thickness of the thermoplastic layer of the invention is 20 μm and less, and the range from 0.5 μm to 8 μm is more preferable.

It is desirable that the support used for the thermal transfer recording medium of the invention has a heat-resistance power, a high dimensional stability and an excellent surface smoothness. As a material of the support, papers such as an ordinary paper, a condenser paper, a laminated paper and a coated paper, for example, and resin films such as polyethylene, polyethyleneterephthalate, polystyrene, polypropylene and polyimido, paper-resin film compound and metal sheet such as aluminum foil may be used conveniently. The thickness of the support is usually 60 μm and less for assuring the satisfactory heat-conductivity and the range from 1.5 μm to 15 μm is more preferable. Incidentally, an arrangement of the reverse side of the support in the thermal transfer recording medium of the invention is not restricted and a backing layer such as a sticking-prevention layer may be provided thereon.

The technologies suitable for coating the structural layer including a heat-fusible layer and a thermoplastic layer on the support such as a polymer film in the thermal transfer recording medium of the invention are known in the present industry and these known technologies may be applied even to the present invention. For example, the structural layer including a heat-fusible layer and a thermoplastic layer is a layer on which the ingredients disolved or half-dissolved in a solvent are coated by means of the solvent-coating, or a layer on which the aqueous dispersed structural products (latex) are formed by means of aqueous coating. As a means for coating the structural layer having therein a heat-fusible layer and a thermoplastic layer, any of coating methods such as a reverse roller coating method, an extrusion coating method, a gravure coating method and a wire bar coating method may be employed.

The heat-transfer recording medium of the invention may have other structural layers such as a subbing layer (e.g. a layer for controlling the adhesion) or an overcoat layer and others.

A thermal transfer recording method wherein the heat-transfer recording medium of the invention is used will be explained as follows.

When the structural layer surface of the heat-transfer recording medium and an ordinary paper are superposed and energy is given from the side of the heat-transfer recording medium and/or the side of the recording sheet according to image information by means of a thermal recording attaratus employing a thermal head, a thermal pen or laser comparatively low energy causes coloring agents and thermoplastic substances both in the thermoplastic layer to be transferred onto the recording sheet.

EXAMPLES

Examples of the invention will be given as follows, but the embodiment of the invention is not limited to them. In the example, the expression 'parts' is used in the meaning of 'parts by weight'.

EXAMPLE 1

(a) Preparation of cross-linking polymer emulsion styrene. . . . . 50 parts
2-ethylhexylmethacrylate. . . . . 25 parts
methylmethacrylate. . . . . 22 parts
azobisisobutyronitrile. . . . . 3 parts
divinyl benzene. . . . . 0.2 parts Suspension containing composition were substituted with nitrogen and heated at 60° C. for 24 hours the suspension polymerization and then heated further at 95° C. for 6 hours for the completion of the polymerization. Emulsion (a) of poly (styrene-2-ethylhexylmethacrylate-methylmethacrylatedevinylbenzene) (solids contaied: 20%) was prepared.

(b) Coating of heat-fusible layer

Following structural substances for coating were coated on a polyethyleneterephthalate film of 3.5 μm thick by means of a wire bar, assuring the thickness of dried coating of 3.0 μm, thus the heat-fusible layer was formed. Paraffin wax emulsion (an emulsion prepared by emulsifying paraffin wax having the melting point of 70° C. in water by the use of polyethylene glycol monostearyl ether, solids contained:

| | |
|---|---|
| paraffin wax emulsion (an emulsion prepared by emulsifying paraffin wax having the melting point of 70° C. in water by the use of polyethylene glycol monostearyl ether. solids contained: 30%) | 85 parts |
| ethylene-vinyl acetate copolymer emulsion (Adcote AD-37P295 made by Toyo Morton Co. solids contained: 40%) | 11.25 parts |
| aqueous solution containing 2% of fluorine type surfactant (FT-248 made by Bayer Co.) | 2.5 parts |

(c) Coating of thermoplastic layer

Coating solution for thermoplastic layer having the following composition was coated on aforesaid heat-fusible layer, assuring the thickness of dried coating of 1.2 μm, thus the thermal transfer recording medium (A) of the invention was obtained.

| | |
|---|---|
| aqueous carbon black-dispersion (solids contained: 30%) | 10 parts |
| acrylic acid ester copolymer latex (Polysol AP-691. made by Showa Kobunshi Co. solids contained: 54%) | 25 parts |
| aforesaid cross-linking polymer emulsion (a) | 10 parts |
| aqueous solution containing 2% of fluorine type surfactant (FT-248 made by Bayer Co.) | 5 parts |
| water | 50 parts |

Dynamic viscosity and dynamic elasticity of aforesaid thermoplastic layer were measured by the use of rheometer made by Shimazu Co. The viscosity at 100° C. was $4.3\times10^3$dyne.sec/cm$^2$ and the elasticity at the same temperature was $3.8\times10^3$dyne/cm$^2$.

COMPARATIVE EXAMPLE 1

(a) Preparation of non-cross-linking polymer emulsion styrene. . . . . 50 parts
2-ethylhexylmethacrylate. . . . . 25 parts
methylmethacrylate. . . . . 22 parts
azobisisobutyronitrile. . . . . 3 parts The suspension having aforesaid composition was polymerized in the method exactly the same as that of Example 1 and an emulsion (b) of poly (styrene-2-ethylhexylmethacrylate-methylmethacrylate) (solids contained: 20%) was prepared.

(b) Coating of heat-fusible layer

The heat-fusible layer was prepared in the method exactly the same as that of Example 1.

(c) Coating of thermoplastic layer

Comparative thermal transfer recording medium sample (S-1) was prepared in the method exactly the same as that of Example 1 except that aforesaid non-cross-linking polymer emulsion (b) was used in place of cross-linking polymer emulsion in the coating solution for the thermoplastic layer in Example 1.

The viscosity of aforesaid thermoplastic layer at 100° C. was $4.2\times10^3$dyne.sec/cm$^2$ and the elasticity was $1.1\times10^3$dyne/cm$^2$.

COMPARATIVE EXAMPLE 2

The heat-fusible layer exactly the same as that in Example 1 was coated on a polyethyleneterephthalate film and then the coating solution for the thermoplastic layer having the following composition was coated on aforesaid heat-fusible layer, assuring the thickness of dried coating of 1.2 μm, thus the comparative thermal transfer recording medium sample (S-2) was prepared.

| | |
|---|---|
| aqueous carbon black-dispersion (solids contained: 30%) | 10 parts |
| urethane resin latex (Bondic 1050 made by Dainihon Ink Kagaku Co. solids contained: 47%) | 25 parts |
| non-cross-linking polymer emulsion (b) | 10 parts |
| aqueous solution containing 2% of fluorine type surfactant (FT-248 made by Bayer) | 5 parts |
| water | 50 parts |

The viscosity of this thermoplastic layer at 100° C. was $9.8\times10^3$dyne.sec/cm$^2$, while the elasticity was $3.7\times10^3$dyne/cm$^2$.

Printing was made on a rough paper (Bekk smoothness: 10 sec) through aforesaid thermal transfer recording medium sample, with impressed energy of $1.0_{mj}$/dot given, by the use of a thermal printer (trial model provided with a thin type serial head having a heating element density of 7 dot/mm, wherein a printing pressure is 600 g/head and a hardness of platen rubber is 50°). The results therefrom are shown in Table 1.

TABLE 1

| Sample | Transfer-ability *1 | Fixing characteristic *2 | correction *3 |
|---|---|---|---|
| A (this | o | o | o |

TABLE 1-continued

| Sample | Transfer-ability *1 | Fixing characteristic *2 | correction *3 |
|---|---|---|---|
| invention) | | | |
| S-1 (comparative) | o | o | x |
| S-2 (Comparative) | x | x | o |

*1 2-step evaluation by means of visual check
o . . . reproduction of clear-cut alphabets
x . . . blurred reproduction of alphabets
*2 After rubbing a printed area with a rubber eraser, the residual image is to be checked visually under 2-step evaluation.
o . . . Density of recorded image mostly remains unchanged.
x . . . Density of recorded image is reduced considerably.
*3 After applying an adhesive tape on a printed area and impressing thermal energy thereon and removing the tape, the recorded image is to be checked visually under 2-step As is clear from the Table, only the thermal transfer recording medium sample having the constitution of the invention shows an excellent transferability and fixing characteristic even on the rough paper and further it is possible to correct easily the erroneous recording by means of the lift-off method.

We claim:

1. A thermal transfer recording medium comprising a support and, provided thereon in order from the support, a heat-fusible layer containing a heat-fusible substance and a thermoplastic layer containing a thermoplastic resin, a coloring agent and cross-linking polymer selected from the group consisting of a copolymer of styrene and divinylbenzene, a copolymer of vinyl chloride and divinylbenzene, a copolymer of polypropylene and divinylbenzene, a copolymer obtained by copolymerization of a composition of vinyl acetate and a small amount of vinyl adipate added thereto and a polycondensation product of glycerol and phthalic acid, said cross-linking polymer being present in a quantity of 5 to 40% by weight with respect to the total solid components constituting said thermoplastic layer.

2. The thermal transfer recording medium of claim 1, wherein said heat-fusible substance is selected from a subtance which is solid or semi-solid at room temperature and has a melting point or softening point in the range of from 25° C. to 120° C.

3. The thermal transfer recording medium of claim 2, wherein said melting point or softening point is in the range from 40° C. to 120° C.

4. The thermal transfer recording medium of claim 2, wherein said heat-fusible substance is a wax.

5. The thermal transfer recording medium of claim 1, wherein said cross-linking polymer is a copolymer of styrene and divinylbenzene.

6. A thermal transfer recording medium comprising a support and, provided thereon in order from the support, a first layer containing a heat-fusible substance and a second layer comprising a thermoplastic resin at a proportion of 5–90 parts by weight, and a coloring agent at a proportion of 5–40 parts by weight and a cross-linking agent at a proportion of 5–40 parts by weight with respect to the total amount of solid components contained therein, said crosslinking agent being selected from the group consisting of a copolymer of styrene and divinylbenzene, a copolymer of vinyl chloride and divinylbenzene, a copolymer of polypropylene and divinylbenzene, a copolymer obtained by copolymerization of a composition of vinyl acetate and a small amount of vinyl adipate added thereto and a polycondensation product of glycerol and phthalic acid.

7. The thermal transfer recording medium of claim 6, wherein said cross-linking polymer is a copolymer of styrene and divinylbenzene.

* * * * *